United States Patent [19]

Ogawa et al.

[11] Patent Number: 4,776,854

[45] Date of Patent: Oct. 11, 1988

[54] METHOD FOR FLAMEPROOFING CELLULOSIC FIBROUS MATERIALS

[75] Inventors: Yoshikatsu Ogawa, Takatsuki; Hitoshi Hirose, Yahata; Noriyuki Shiina, Suita; Hideaki Okutani, Osaka, all of Japan

[73] Assignee: Marubishi Yuka Kogyo Kabushiki Kaisha, Osaka, Japan

[21] Appl. No.: 844,785

[22] Filed: Mar. 27, 1986

[30] Foreign Application Priority Data

Jun. 25, 1985 [JP] Japan ..... 60-136942

[51] Int. Cl.[4] ..... D06M 13/34

[52] U.S. Cl. ..... 8/194; 427/393.3; 252/608; 8/116.1

[58] Field of Search ..... 8/116.1, 194; 427/393.3; 252/608

[56] References Cited

U.S. PATENT DOCUMENTS 3,014,000 12/1961 Read ..... 524/297

3,754,981 8/1973 Nachbur et al. ..... 427/381

*Primary Examiner*—Paul Lieberman

*Assistant Examiner*—John F. McNally

*Attorney, Agent, or Firm*—Michael N. Meller

[57] ABSTRACT

A method for flameproofing cellulosic fibrous materials, which comprises treating a cellulosic fibrous material with a treating liquid comprising 100 parts by weight of an N-hydroxymethyldialkylphosphonopropionamide represented by the following formula:

$$(RO)_2\overset{\overset{O}{\|}}{P}-CH_2CH_2CONHCH_2OH \quad (I)$$

wherein R stands for an alkyl gorup having 1 to 3 carbon atoms, and 10 to 200 parts by weight (as solids) of an antimony oxide sol.

6 Claims, No Drawings

METHOD FOR FLAMEPROOFING CELLULOSIC FIBROUS MATERIALS

BACKGROUND OF THE INVENTION

1. Field of the Invention

The present invention relates to a method for the flameproofing treatment for imparting a washing-resistant flame retardancy to cellulosic fibers or fibrous articles.

2. Description of the Related Art

As the flame retardant for cellulosic fibrous materials, there are known inorganic compounds such as ammonium phosphate, ammonium sulfamate, ammonium bromide, ammonium sulfate, borax, boric acid, guanidine phosphate and guanidine carbonate, organic halogen compounds such as chlorinated paraffin, decabromodiphenyl oxide, tetrabromobisphenol A and tris-2,3-dibromopropyl isocyanurate, phosphorus compounds such as trisdichloropropyl phosphate, trischloroethyl phosphate, tricresyl phosphate, trisisopropylphenyl phosphate, bis-2-chloroethylvinyl phosphonate and diphenyl hydrogenphosphite, and reactive phosphorus compounds such as tetrakishydroxymethyl phosphonium chloride (THPC), tetrakishydroxymethyl phosphonium sulfate (THPS) and dialkylphosphonopropionamide-methylol compounds.

When these flame retardants are applied to surfaces of cellulosic fibrous materials, the surfaces become white or sticky or the materials become rigid and coarse, with the result that the hand is drastically degraded. When water-soluble inorganic compounds are used, the hand is degraded by absorption of moisture. Furthermore, when reactive flame retardants such as THPC, THPS and N-hydroxymethyldialkylphosphonopropionamide are used according to prescribed methods, the strength of cellulosic fibrous materials is reduced by 20 to 60% and discoloration is caused in dyes, and moreover, bad odors are generated at the treating step and corrosive substances such as hydrogen chloride, sulfuric acid and formaldehyde are formed causing corrosion of treating equipment. Accordingly, devices for coping with bad odors and corrosive substances must be provided. Furthermore, this method is defective in that treated articles reek of bad odors.

SUMMARY OF THE INVENTION

It is the primary object of the present invention to provide a method for flameproofing cellulosic fibrous materials, which overcomes the above-mentioned defects of the conventional techniques.

In accordance with the present invention, there is provided a method for fireproofing cellulosic fibrous materials, which comprises treating a cellulosic fibrous material with a treating liquid comprising 100 parts by weight of an N-hydroxymethyldialkylphosphonopropionamide represented by the following general formula:

$$(RO)_2\overset{\overset{\displaystyle O}{\|}}{P}-CH_2CH_2CONHCH_2OH \qquad (I)$$

wherein R stands for an alkyl group having 1 to 3 carbon atoms, and 10 to 200 parts by weight (as solids) of an antimony oxide sol.

DESCRIPTION OF THE PREFERRED EMBODIMENTS

Figure 1:
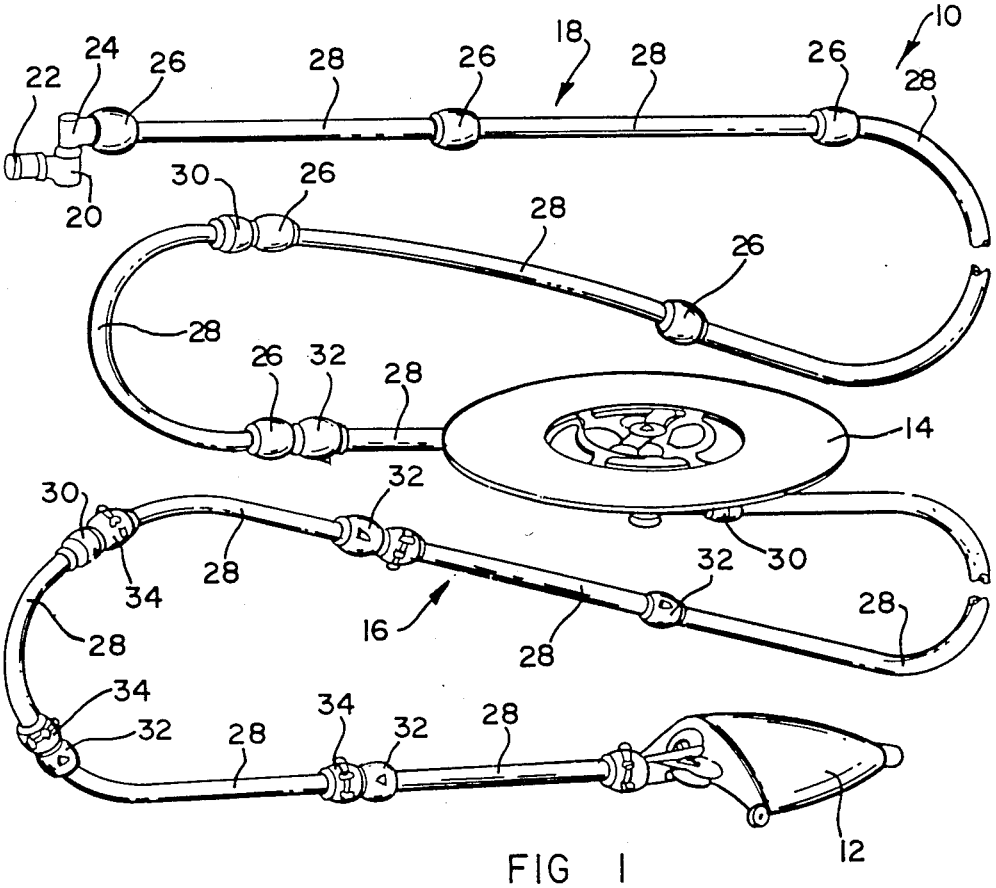

According to the method of the present invention, at the treating step, corrosive substances are not formed nor bad odors generated, and there can be obtained a treated article which has excellent washing resistance and has no odor and no reduction in strength.

When a treated article is used in a field where the amount of formalin should be reduced or the hand should be maintained at a high level, for example, when clothing or bedding is treated, if the treated article is passed through an aqueous solution of an amino group-containing compound such as urea, melamine, dicyandiamide or guanidine carbonate after the flameproofing treatment, the amount of formalin is reduced, and if the treated article is processed with a cationic, nonionic, anionic or silicone softener, there can be obtained an article having excellent softness.

The cellulosic fibrous material used in the present invention may be a fiber or fibrous article mix-spun, mix-woven or mix knitted with other fiber or fibrous article, and this fiber or fibrous article may be one that has been subjected to dyeing, resin processing, mildew-proofing treatment, insecticidal treatment, water-repellent treatment or oil-repellent treatment. The cellulosic fibrous material includes industrial materials such as yarns, sheets, woven fabrics, knitted fabrics and nonwoven fabrics, industrial and household fibrous articles, clothes, bedclothes, beddings, interior articles, exterior articles, sporting articles, and daily and miscellaneous goods. For example, there can be mentioned canvas, tents, sheets, ropes, curtains, carpets, wall covers, chair covers, bedclothes, mattress, blankets, sheeting, wadding, working clothes, pajamas, ribbons, braids and napped products.

The treating liquid used in the present invention comprises 100 parts by weight of a treating agent represented by the general formula (I) and 10 to 200 parts by weight (as solids), preferably 30 to 150 parts by weight, of an antimony oxide sol. If the amount of the antimony oxide sol is smaller than 10 parts by weight, a bad odor is generated at the treating step, and the treated article reeks of this bad odor and the tensile strength of the treated article is reduced. If the amount of the antimony oxide sol exceeds 200 parts by weight, the treated article becomes coarse and rigid and the hand is degraded.

A solvent, an activator, an emulsifier, a dispersant, a penetrant, a colorant such as a dye, a water repellant, an oil repellant, an anti-staining agent, a mildew-proofing agent, an insecticidal agent, a softener, a finishing agent, a resin processing agent, an ultraviolet absorber, an antioxidant, a redox agent, a thickener, a catalyst and a flame retardant may be added to the treating liquid according to need.

In carrying out the present invention, a cellulosic fibrous material is treated with the treating liquid to stick solids of the treating liquid to the fibrous material. As the treatment method, there may be adopted a method in which the fibrous material is dipped in the treating liquid and a method in which the fibrous material is coated with the treating liquid by using a spraying device, a brush, a roller or the like.

When the flameproofing treatment is carried out, it is preferred that the solids of the treating liquid be deposited on the fibrous material in an amount of 3 to 80% by weight based on the weight of the fibrous material. If the amount of the solids deposited is smaller than 3%, the flameproofing effect is insufficient, and if the amount of the solids deposited is larger than 80%, no particular improvement of the flameproofing effect can be attained but the touch is often degraded.

There may be adopted a method in which a treating liquid having a low concentration is coated on the fibrous material several times repeatedly, but it is preferred that the concentration of the treating liquid be adjusted so that a predetermined amount of solids can be deposited on the fibrous material by one treating operation.

When a fibrous material to be used in the field where the amount of formalin or the touch is important is subjected to the flameproofing treatment, if the fibrous material is passed through an aqueous solution of an amino group-containing compound such as urea, melamine, dicyandiamide or guanidine carbonate after the flameproofing treatment, the amount of formalin can be reduced, and if the fibrous material is processed with a cationic, nonionic, anionic or silicone softener, there can be obtained an article having excellent softness.

The present invention will now be further illustrated with reference to the following non-limitative examples.

EXAMPLE 1

A treating liquid was prepared by adding 75 parts of an antimony oxide sol (solids content=45%) and 43 parts of water to 25 parts of N-hydroxymethyldiethylphosphonopropionamide.

The antimony oxide sol used was one prepared by mixing 22.6 parts of antimony trioxide (supplied by Sumitomo Kagaku) with 15.0 parts of 35% hydrogen peroxide, 1.1 parts of triethanol amine and 61.3 parts of water, heating the mixture at 70° C. for 1 hour to effect reaction, removing water from the reaction mixture by distillation so that the solids content was 45% and adding 4% of triethanolamine to the residue. This antimony sol was characterized by a pH value of 9.0, a specific gravity of 1.521 (15° C.) and a viscosity of 13.7 cps (20° C.).

A side cotton broadcloth for a bedquilt (having a basis weight of 150 g/m$^2$) was dipped in this treating liquid under one-dip/one-nip condition and squeezed at a pick-up of 80% by using a mangle. Then, the bedcloth was dried at 80° C. for 10 minutes and then cured at 150° C. for 4 minutes. A 5% solution of urea was prepared and heated to 50° C., and the treated bedcloth was immersed in the heated urea solution and washed with water for 5 minutes to remove free formalin. Then, the bedcloth was dipped in a 0.3% solution of an anionic softener at a goods to liquor ratio of 1/30 at a temperature of 40° C. for 5 minutes to effect softening processing, and the bedcloth was squeezed by a mangle and dried at 80° C. for 15 minutes to obtain a product. The flame retardancy, the amount of formalin, the tensile strength and the hand were evaluated.

The flame retardancy was evaluated by washing the treated sample according to the method of the Japanese Fire Defence Agency Notice No. 11 (June 1, 1973) and carrying out the test according to the 45-degree methenamine method for flameproof products specified in the Japanese Fire Defence Agency Notice No. 65 (June 25, 1974).

The amount of formalin was determined according to the method set forth the Japanese Official Gazette No. 14323 (Sept. 26, 1974).

The tensile strength was measured by using a tensile tester (Model UTM-4-100 supplied by Toyo Sokki).

The obtained results are as follows:

(a) Flame Retardancy (after repeated water washing 30 times)

Afterflaming time: 0 second
Afterglow time: 0 second
Char length: 3.0 cm.

(b) Amount of Formalin 30 ppm on the average (n=3).

(c) Tensile Strength

| | Longitudinal Direction | Lateral Direction |
|---|---|---|
| Untreated sample | 25 Kg | 12.8 Kg |
| Treated sample | 25.8 Kg | 12.3 Kg |

(d) Hand

Very good (softness and feel).

EXAMPLE 2

A treating liquid was prepared by adding 70 parts of an antimony oxide sol having a solids content of 50% (supplied by Nissan Kagaku) and 45 parts of water to 25 parts of N-hydroxymethyldiethylphosphonopropionamide. A bleached cotton canvas #10 (having a basis weight of 409 g/m$^2$) was dipped in the treating liquid under 2-dip/2-nip condition and squeezed at a squeeze ratio of 90% by using a mangle. The treated canvas was dried at 80° C. for 10 minutes and cured at 150° C. for 4 minutes. Then, the canvas was dipped in a 0.3% solution of a cationic softener at a goods to liquor ratio of 1/30 at 40° C. for 5 minutes to effect a softening treatment. Then, the canvas was squeezed by a mangle and dried at 80° C. for 15 minutes. The flame retardancy, the amount of formalin, the tensile strength and the hand were evaluated. The flame retardancy was evaluated according to the flameproof test method A for thick fiber fabrics specified in Ordinance No. 3 of the Japanese Ministry of Home Affairs. Other tests were carried out in the same manner as described in Example 1. The obtained results are as follows:

(a) Flame Retardancy (45-degree Meker burner method)

Afterflaming time: 0 second
Afterglow time: 0 second
Char area: 28 cm$^2$.

(b) Amount of Formalin 80 ppm.

(c) Tensile Strength

| | Longitudinal Direction | Lateral Direction |
|---|---|---|
| Untreated sample | 64.8 Kg | 76.6 Kg |
| Treated sample | 61.5 Kg | 61.0 Kg |

(d) Hand

Very good (softness and appearance).

EXAMPLE 3

A treating liquid was prepared by adding 60 parts of the same antimony oxide sol (having a solids content of 45%) as used in Example 1 and 40 parts of water to 25 parts of N-hydroxymethyldiethylphosphonopropionamide, and a mix-spun fabric (having a basis weight of 187 g/m$^3$) comprising 65% of cotton and 35% of polyester was dipped in the treating liquid under 2-dip/2-nip condition, squeezed at a squeeze ratio of 95% by using a mangle, dried at 80° C. for 10 minutes and cured at 150° C. for 4 minutes.

The flame retardancy of the obtained treated fabric was evaluated by washing the fabric according to the method of the Japanese Fire Defence Agency Notice No. 11 (June 1, 1973) and subjecting the fabric to the fireproof test for thin fabrics specified in Ordinance No. 3 of the Japanese Ministry of Home Affairs. Other tests were carried out in the same manner as described in Example 1. The obtained results are as follows.

(a) Flame Retardancy (45-degree microburner method after repeated water washing 5 times)

Afterflaming time: 0 second

Afterglow time: 0 second

Char area: 18 $cm^2$.

(b) Amount of Formalin 70 ppm.

(c) Tensile Strength

| | Longitudinal Direction | Lateral Direction |
|---|---|---|
| Untreated sample | 87.7 Kg | 66.6 Kg |
| Treat sample | 85.0 Kg | 64.0 Kg |

(d) Hand

Very good (softness and feel).

EXAMPLE 4

A treating liquid was prepared by adding 50 parts of the same antimony oxide sol (having a solids content of 45%) as used in Example 1 and 40 parts of water to 25 parts of N-hydroxymethyldimethylphosphonopropionamide. A cotton knitted fabric (having a basis weight of 170 g/$m^2$) was dipped in the treating liquid, squeezed at a squeeze ratio of 95% by using a mangle, dried at 80° C. for 10 minutes and cured at 150° C. for 4 minutes. Then, the fabric was dipped in a 0.3% solution of a nonionic softener at 40° C. for 5 minutes to effect a softening treatment, squeezed by a mangle and dried at 80° C. for 5 minutes. Then, the flame retardancy, the amount of formalin, the tensile strength and the touch were evaluated. The flame retardancy was evaluated by conducting washing 50 times according to AATCC 124-69 (Test 11-B) and subjecting the fabric to the combustion test for children's sleepers according to DOC FF-3-71. Other tests were carried out in the same manner as described in Example 1. The obtained results are as follows.

(a) Flame Retardancy (vertical method, flame contact time of 3 seconds)

Afterflaming: 0 second

Char length: 9 cm.

(b) Amount of Formalin 65 ppm.

(c) Tensile Strength

| | Longitudinal Direction | Lateral Direction |
|---|---|---|
| Untreated sample | 22.7 Kg | 8.4 Kg |
| Treated sample | 20.0 Kg | 8.0 Kg |

(d) Hand

Very good.

EXAMPLE 5

A treating liquid was prepared by adding 55 parts of the same antimony oxide sol (having a solids content of 45%) as used in Example 1, 40 parts of water and 0.1 part of 35% hydrogen peroxide to 25 parts of N-hydroxymethyldipropylphosphonopropionamide. A cotton fabric (having a basis weight of 255 g/$m^2$) was dipped in the treating liquid under 2-dip/2-nip condition, squeezed at a squeeze ratio of 85% by using a mangle, dried at 80° C. for 10 minutes and cured at 150° C. for 4 minutes. Then, the treated fabric was dipped in a 0.3% solution of a cationic softener at 40° C. for 5 minutes at a goods to liquor ratio of 1/30 to effect a softening treatment, and the fabric was squeezed by a mangle and dried at 80° C. for 15 minutes. The flame retardancy, the amount of formalin, the tensile strength and the hand were evaluated.

The flame retardancy was determined by carrying out washing according to the method of the Japanese Fire Defence Agency Notice No. 11 (June 1, 1973) and subjecting the fabric to the fireproof test for thin fabrics specified in Ordinance No. 3 of the Japanese Ministry of Home Affairs. Other tests were carried out in the same manner as described in Example 1. The obtained results are as follows.

(a) Flame Retardancy (45-degree microburner method after repeated water washing 5 times)

Afterflaming time: 0 second

Afterglow time: 0 to 3 seconds

Char area: 25 $cm^2$.

(b) Amount of Formalin 45 ppm.

(c) Tensile Strength

| | Longitudinal Direction | Lateral Direction |
|---|---|---|
| Untreated sample | 49.8 Kg | 36.8 Kg |
| Treated sample | 44.9 Kg | 37.0 Kg |

(d) Hand

Very good (also the drapeability was good).

COMPARATIVE EXAMPLE 1

A treating liquid was prepared by adding 70 parts of water to 30 parts of N-hydroxymethyldiethylphosphonopropionamide. A cotton fabric (having a basis weight of 255 g/$m^2$) was dipped in this treating liquid under 2-dip/2-nip condition, squeezed at a pick-up of 85% by using a mangle, dried at 80° C. for 10 minutes and cured at 150° C. for 4 minutes. Then, the treated fabric was dipped in a 0.3% solution of a cationic softener at a goods to liquor ratio of 1/30 at 40° C. for 5 minutes to effect a softening treatment, and the fabric was squeezed by a mangle and dried at 80° C. for 15 minutes. The flame retardancy, the amount of formalin, the tensile strength and the hand were evaluated.

The flame retardancy was evaluated by carrying out washing according to the method of the Japanese Fire Defence Agency Notice No. 11 (June 1, 1974) and subjecting the fabric to the fireproof test for thin fabrics specified in Ordinance No. 3 of the Japanese Ministry of Home Affairs. Other tests were carried out in the same manner as described in Example 1. The obtained results are as follows.

(a) Flame Retardancy (45-degree microburner method).

Completely burnt at the test conducted after repeated water washing 5 times.

(b) Amount of Formalin 400 ppm.

(c) Tensile Strength

| | Longitudinal Direction | Lateral Direction |
|---|---|---|
| Untreated sample | 49.8 Kg | 36.8 Kg |
| Treated sample | 24.0 Kg | 18.7 Kg |

(d) Hand

Very hard and bad hand with formalin odor.

COMPARATIVE EXAMPLE 2

A treating liquid was prepared by adding 60 parts of water to 40 parts of the same antimony oxide sol as used in Example 1. A cotton fabric (having a basis weight of 255 g/m$^2$) was dipped in the treating liquid under 2-dip/2nip condition, squeezed at a pick-up of 85% by using a mangle, dried at 80° C. for 10 minutes and cured at 150° C. for 4 minutes. The treated fabric was dipped in a 0.3% solution of a cationic softener at a goods to liquor ratio of 1/30 at 40° C. for 5 minutes to effect a softening treatment. The fabric was squeezed by a mangle and dried at 80° C. for 15 minutes. The flame retardancy, the amount of formalin, the tensile strength and the hand were evaluated. The flame retardancy was determined by carrying out washing according to the method of the Japanese Fire Defence Agency Notice No. 11 (June 1, 1973) and subjecting the fabric to the fireproof test for thin fabrics specified in Ordinance No. 3 of the Japanese Ministry of Home Affairs. Other tests were carried out in the same manner as described in Example 1. The obtained results are as follows.

(a) Flame Retardancy (45-degree microburner method)

Completely burnt at the test conducted after repeating washing 5 times.

(b) Amount of Formalin 0 ppm.

(c) Tensile Strength

| | Longitudinal Direction | Lateral Direction |
|---|---|---|
| Untreated sample | 49.8 Kg | 36.8 Kg |
| Treated sample | 35.3 Kg | 24.5 Kg |

(d) Hand

Very hard and bad.

We claim:

1. A method for flameproofing cellulosic fibrous materials, which comprises treating a cellulosic fibrous material with a treating liquid comprising 100 parts by weight of an N-hydroxymethyldialkylphosphonopropionamide represented by the following formula:

$$(RO)_2\overset{\overset{\displaystyle O}{\|}}{P}-CH_2CH_2CONHCH_2OH \qquad (I)$$

wherein R stands for an alkyl group having 1 to 3 carbon atoms, and 10 to 200 parts by weight (as solids) of an antimony oxide sol.

2. A flameproofing method as set forth in claim 1, wherein the treating liquid comprises 30 to 150 parts by weight (as solids) of the antimony oxide sol per 100 parts by weight of the N-hydroxymethyldialkylphosphonopropionamide.

3. A flameproofing method as set forth in claim 1, wherein the solids of the treating liquid are deposited on the fibrous material in an amount of 3 to 80% by weight based on the weight of the fibrous material.

4. A flameproofing method as set forth in claim 1, wherein the fibrous material is passed through an aqueous solution of an amino group-containing compound after the flameproofing treatment.

5. A flameproofing method as set forth in claim 4, wherein the amino group-containing compound is selected from the group consisting of urea, melamine, dicyandiamide and guanidine carbonate.

6. A flameproofing method as set forth in claim 1, wherein the fibrous material is treated with a softener after the flameproofing treatment.

* * * * *

UNITED STATES PATENT AND TRADEMARK OFFICE

CERTIFICATE OF CORRECTION

PATENT NO. : 4,776,854

DATED : October 11, 1988

INVENTOR(S) : Yoshikatsu Ogawa, et al

It is certified that error appears in the above-identified patent and that said Letters Patent is hereby corrected as shown below:

The title page showing the illustrative figure should be deleted to appear as per attached title page.

Figure 2:
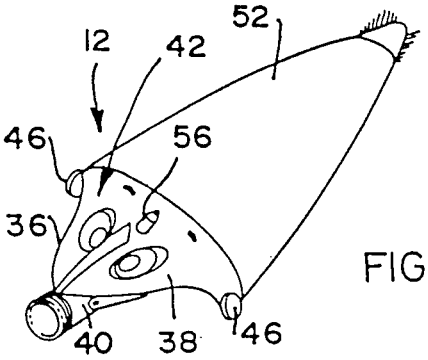
Figure 3:
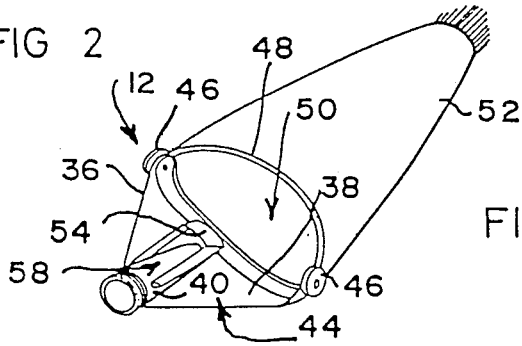
Figure 4:
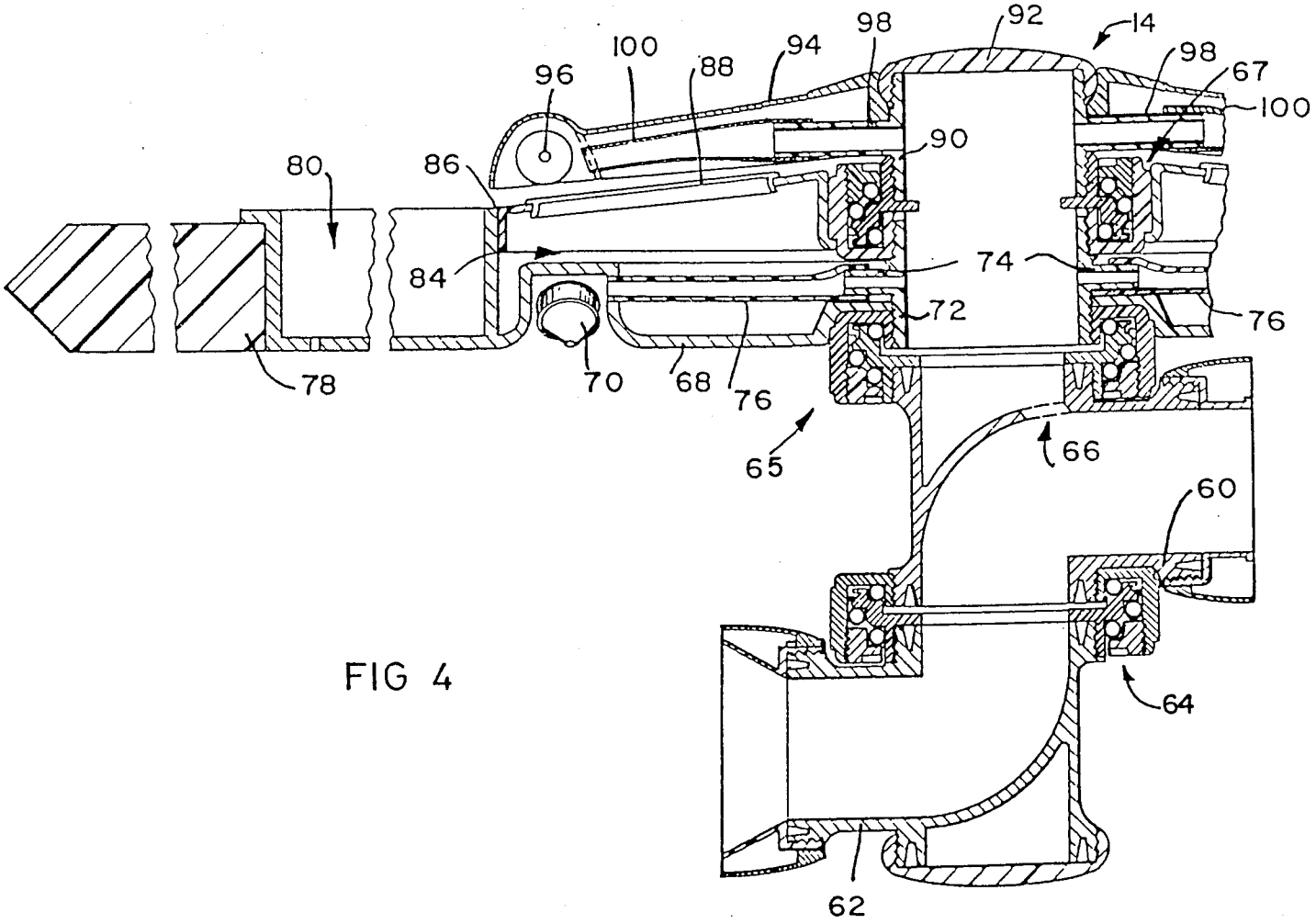
Figure 5:
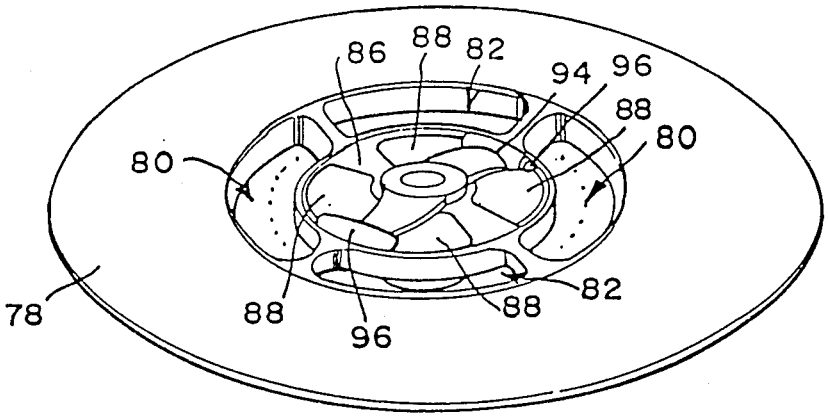
Figure 6:
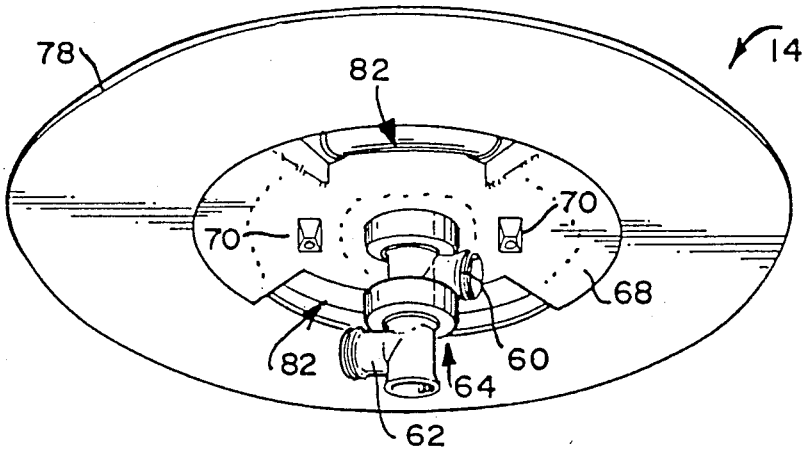
Figure 7:
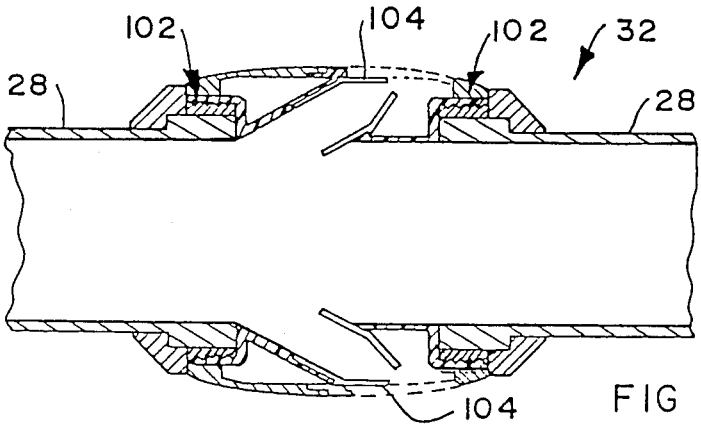
Figure 8:
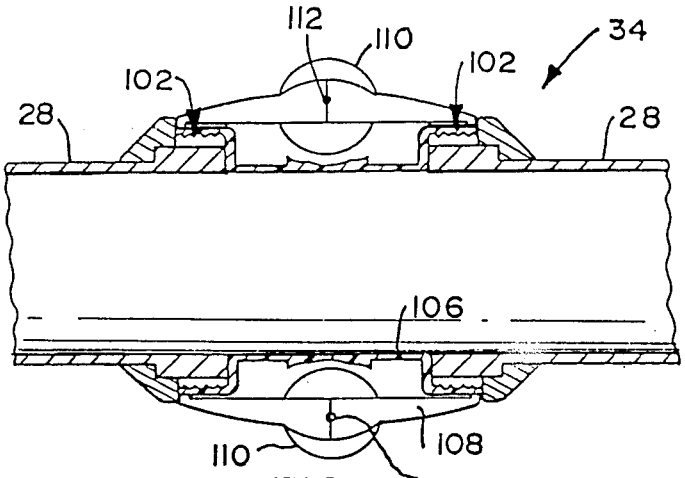
Figure 9:
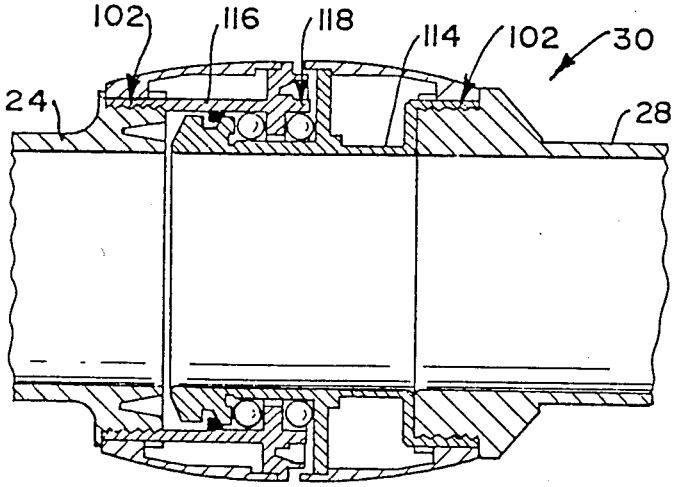
Figure 10:
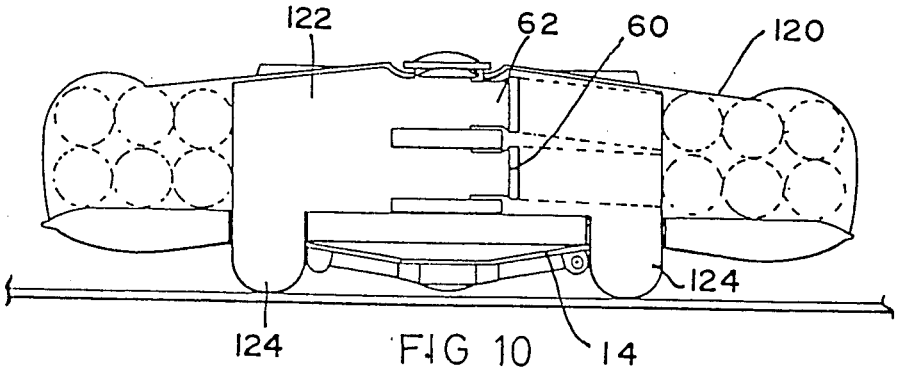
Figure 11:
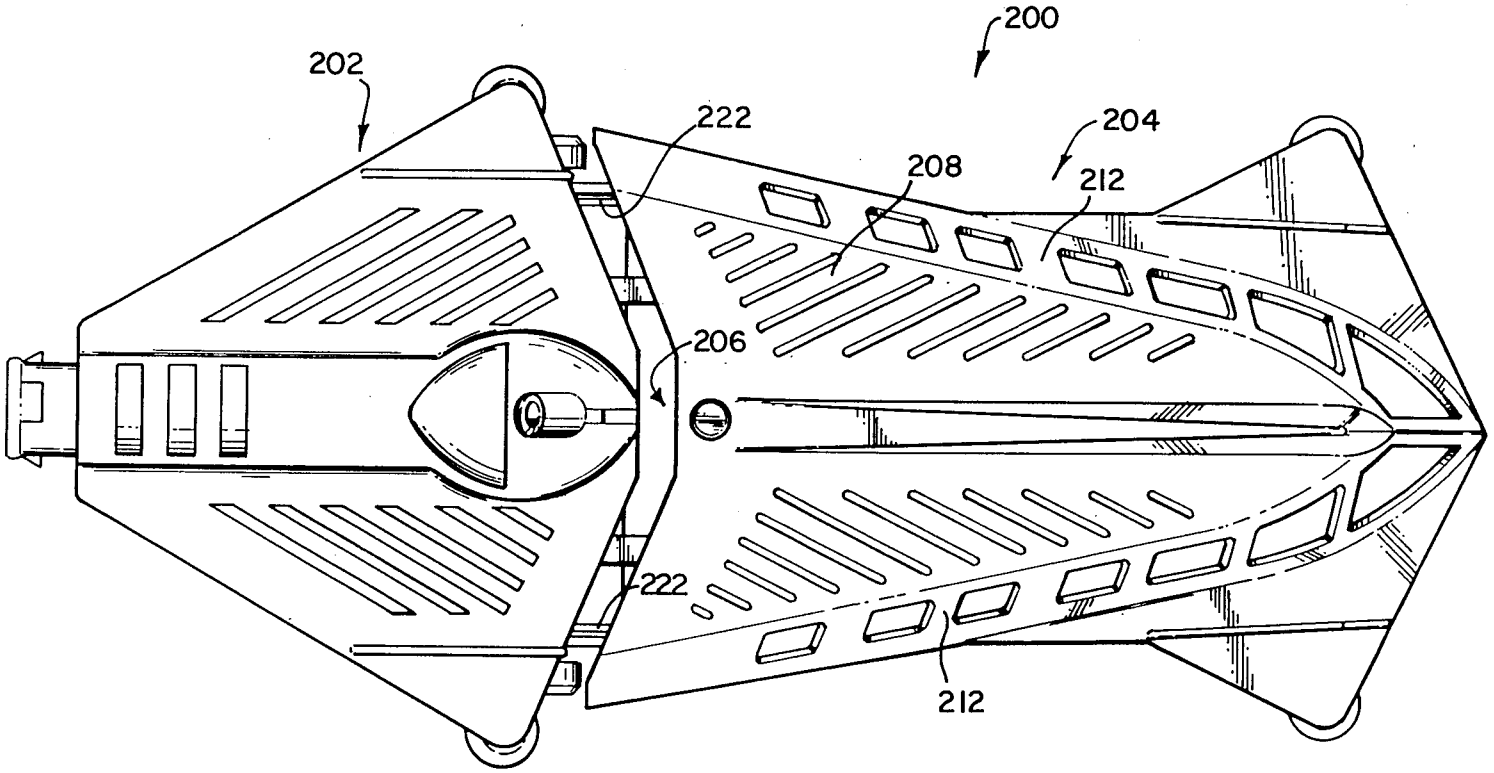
Figure 12:
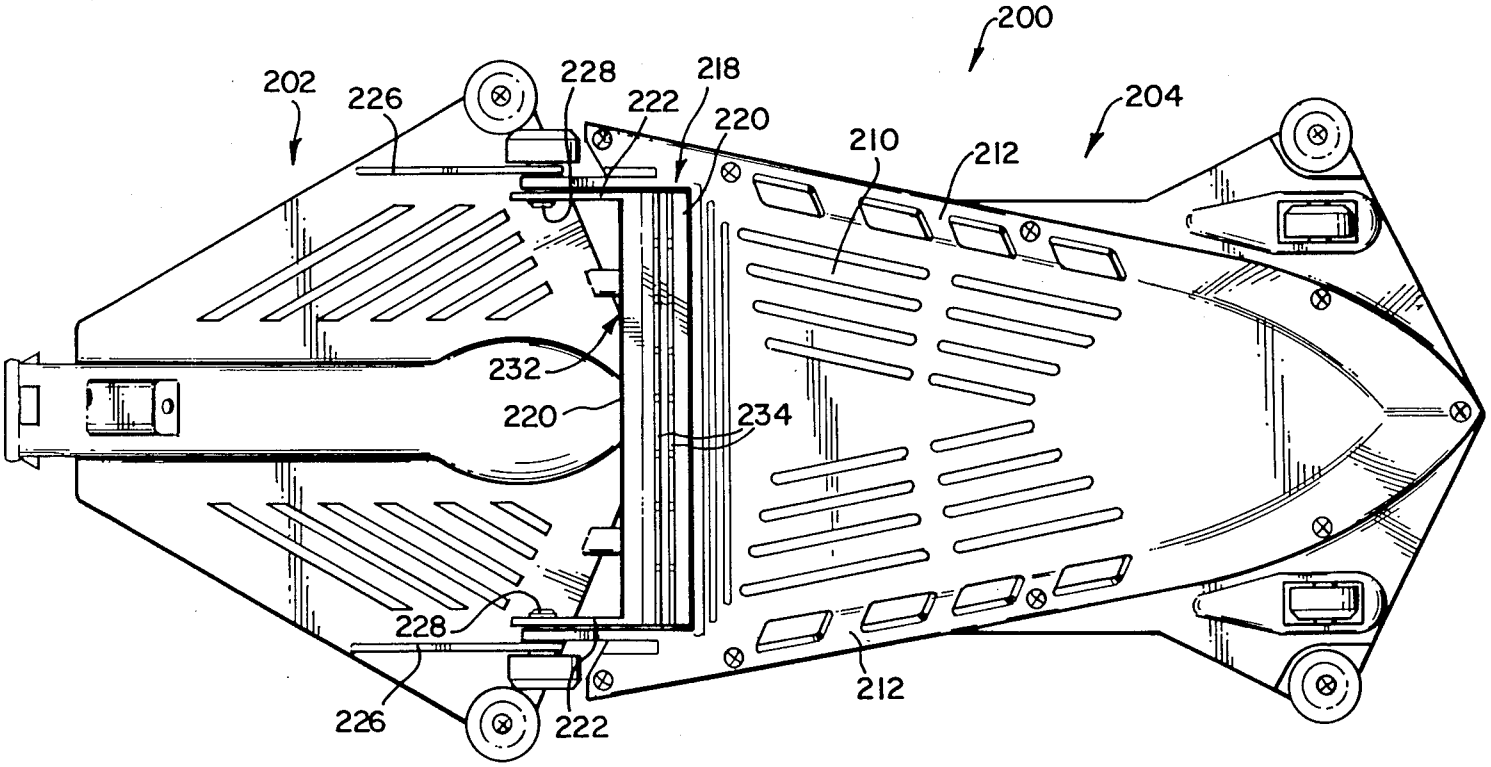
Figure 13:
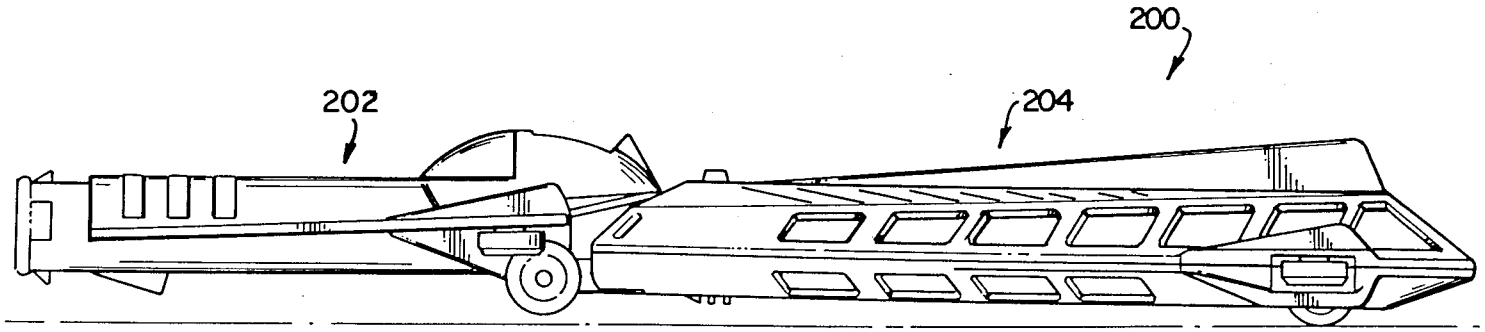
Figure 14:
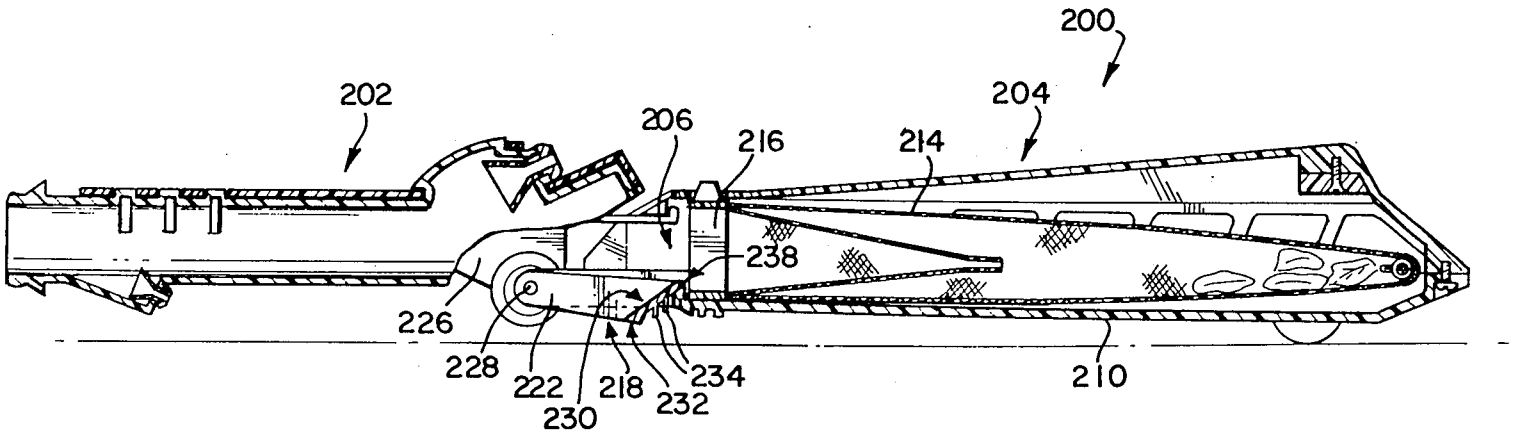
Figure 15:
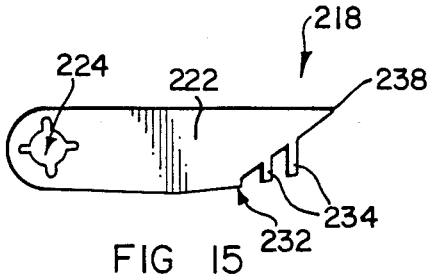
Figure 16:
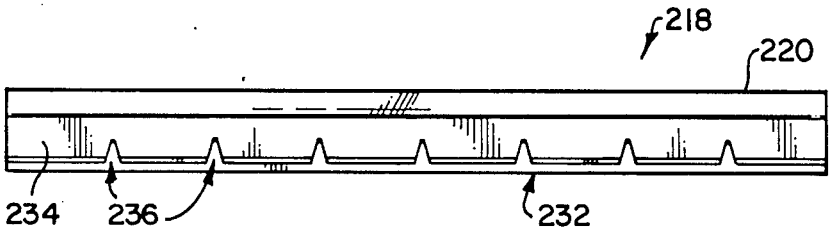
Figure 17:
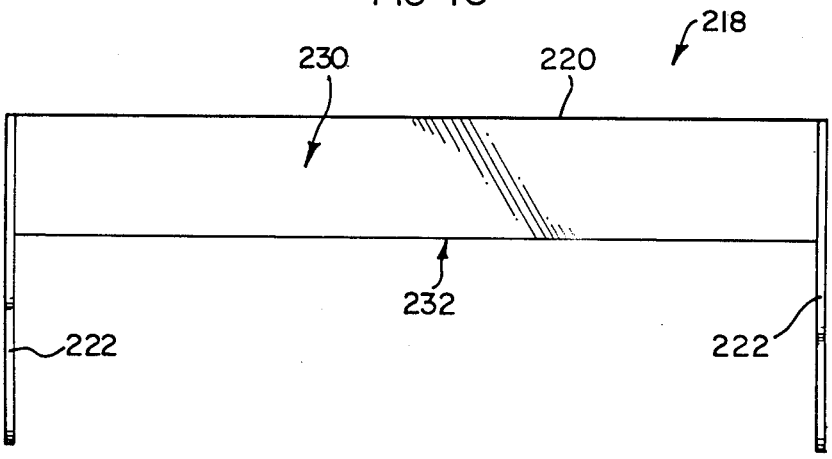
Figure 18:
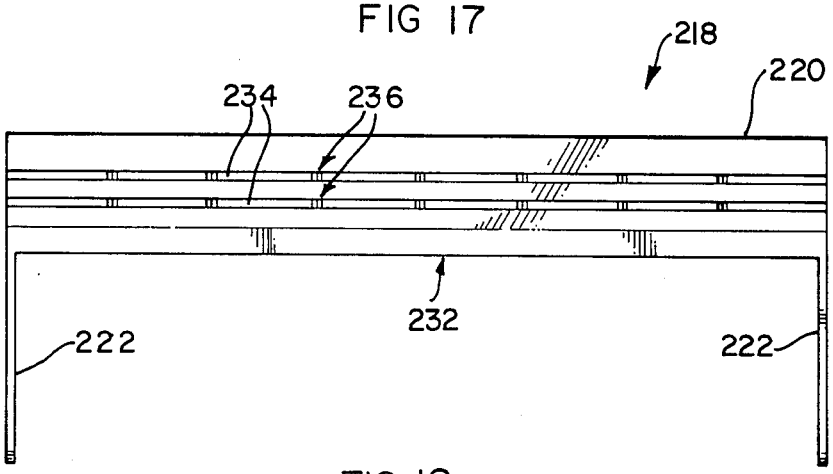

The sheets of Drawing consisting of figures 1-18 should be deleted.

Signed and Sealed this

Twenty-first Day of February, 1989

*Attest:*

DONALD J. QUIGG

*Attesting Officer*

*Commissioner of Patents and Trademarks*

United States Patent [19]
Ogawa et al.

[11] Patent Number: 4,776,854
[45] Date of Patent: Oct. 11, 1988

[54] METHOD FOR FLAMEPROOFING CELLULOSIC FIBROUS MATERIALS

[75] Inventors: Yoshikatsu Ogawa, Takatsuki; Hitoshi Hirose, Yahata; Noriyuki Shiina, Suita; Hideaki Okutani, Osaka, all of Japan

[73] Assignee: Marubishi Yuka Kogyo Kabushiki Kaisha, Osaka, Japan

[21] Appl. No.: 844,785

[22] Filed: Mar. 27, 1986

[30] Foreign Application Priority Data

Jun. 25, 1985 [JP] Japan ..... 60-136942

[51] Int. Cl.[4] ..... D06M 13/34
[52] U.S. Cl. ..... 8/194; 427/393.3; 252/608; 8/116.1
[58] Field of Search ..... 8/116.1, 194; 427/393.3; 252/608

[56] References Cited

U.S. PATENT DOCUMENTS 3,014,000 12/1961 Read ..... 524/297
3,754,981 8/1973 Nachbur et al. ..... 427/381

*Primary Examiner*—Paul Lieberman
*Assistant Examiner*—John F. McNally
*Attorney, Agent, or Firm*—Michael N. Meller

[57] ABSTRACT

A method for flameproofing cellulosic fibrous materials, which comprises treating a cellulosic fibrous material with a treating liquid comprising 100 parts by weight of an N-hydroxymethyldialkylphosphonopropionamide represented by the following formula:

$$(RO)_2\overset{\overset{O}{\|}}{P}-CH_2CH_2CONHCH_2OH \quad (I)$$

wherein R stands for an alkyl gorup having 1 to 3 carbon atoms, and 10 to 200 parts by weight (as solids) of an antimony oxide sol.

6 Claims, No Drawings